United States Patent [19]

Markley

[11] Patent Number: 4,934,546

[45] Date of Patent: Jun. 19, 1990

[54] TAMPER EVIDENT CAP HAVING LIFT TAB ON BOTTOM EDGE

[75] Inventor: Ross L. Markley, Ben Lomond, Calif.

[73] Assignee: Cap Snap Co., San Jose, Calif.

[21] Appl. No.: 302,906

[22] Filed: Jan. 30, 1989

[51] Int. Cl.[5] ..... B65D 41/48

[52] U.S. Cl. ..... 215/256

[58] Field of Search ..... 215/256; 220/270

[56] References Cited

U.S. PATENT DOCUMENTS

| | | | |
|---|---|---|---|
| 3,073,472 | 1/1963 | Williams | 215/256 |
| 3,812,994 | 5/1974 | Feldman | 215/256 |
| 3,913,771 | 10/1975 | Acton et al. | 215/256 |
| 3,940,004 | 2/1976 | Faulstich | 215/256 |
| 4,032,029 | 6/1977 | Cochrane | 220/270 X |
| 4,106,653 | 8/1978 | Martinelli | 215/256 |
| 4,202,455 | 5/1980 | Faulstich | 215/31 |
| 4,387,818 | 6/1983 | Conti | 215/256 |
| 4,496,066 | 1/1985 | Bullock | 215/320 |
| 4,589,561 | 5/1986 | Crisci | 215/256 |
| 4,658,977 | 4/1987 | Crisci | 215/256 |
| 4,667,839 | 5/1987 | Crisci | 215/256 |
| 4,676,389 | 6/1987 | Bullock | 215/256 X |
| 4,678,094 | 7/1978 | Bullock | 215/256 |
| 4,687,114 | 8/1987 | Crisci | 215/256 |
| 4,700,860 | 10/1987 | Li | 215/256 |

FOREIGN PATENT DOCUMENTS 2442341 3/1975 Fed. Rep. of Germany .

*Primary Examiner*—Donald F. Norton

*Attorney, Agent, or Firm*—Julian Caplan

[57] ABSTRACT

A snap-on, tamper evident plastic cap for a plastic bottle neck has a skirt with upper and lower internal locking beads which lock under extenral beads on the neck. The cap is not removable so long as the skirt is intact. The lower end of the skirt, including the lower bead, may be torn off to permit the cap to be removed. To facilitate removal, the cap skirt is formed with a score line which slants upward from the lower edge of the skirt to merge with a circumferential score line which terminates near the origin of the slanted score line. A third score line extends from the terminus of the circumferential score line down to the lower edge of the skirt. Thus there is a tab (a remnant of the original skirt) between the first and third score lines which functions as a lift tab.

7 Claims, 2 Drawing Sheets

TAMPER EVIDENT CAP HAVING LIFT TAB ON BOTTOM EDGE

BACKGROUND OF THE INVENTION

1. Field of the Invention

This invention relates to a new and improved snap-on type tamper evident plastic cap which fits on a plastic bottle neck. The cap is characterized in that when the lower portion of the skirt is torn off to permit removal of the cap, the tear lines are so located that there is a lift tab projecting downward from the upper skirt portion. This lift tab may be used to pry off the upper part of the cap (known as a reclosure cap).

2. Description of Related Art

Caps generally similar to that of the present invention are the subject of co-pending applications of the assignee of this invention.

The neck shown in the accompanying drawings resembles a commercially available neck of the type shown in U.S. Pat. No. 4,667,839. Plural diameter cap skirts which are frangible in a line of weakness between two diameters are shown in numerous prior patents such as Li U.S. Pat. No. 4,700,860.

An improvement upon the aforesaid Li Patent is shown in Assignee's U.S. Pat. No. 4,815,620 issued Mar. 28, 1989, wherein a notch is formed in the external shoulder between the smaller diameter upper skirt and larger diameter lower skirt so that the upper skirt is torn from the lower along a downward-inward slanted line, or, more precisely, conical plane.

Reference is also made to Assignee's U.S. Pat. No. 4,798,301 issued Jan. 17, 1989, on a cap for a wide mouth jar wherein the lower skirt is torn away in such fashion that a lift tab remains on the bottom edge of the reclosure cap.

SUMMARY OF THE INVENTION

The present invention comprises a cap which fits onto the neck of a blow molded plastic bottle and is held thereon in a tamper evident fashion. The skirt of the cap has an upper locking bead which locks under the shoulder of the neck and a lower locking bead adjacent the lower edge of the skirts which locks under a lower locking bead of the neck. The lower portion of the skirt is torn away. To accomplish this result, there is a score line which extends upward in a curved or slanted fashion from the lower edge of the skirt adjacent a pull tab which is used to sever the skirt along the lower score line, thence around a circumferential score line below the upper locking bead to a terminus from which there is a third score line extending down to the bottom edge of the skirt. Between the first mentioned score line and the last mentioned score line the lower skirt is not torn away. Therefore, between the first mentioned score line and the last mentioned score line there is a lift tab which may be used to pry off the reclosure cap (i.e., the portion of the cap above the circumferential score line). The third scoreline may be vertical or may curve downwardly, as shown in two different embodiments.

Other embodiments of the present invention will become apparent upon reading the following specification and referring to the accompanying drawings in which similar characters of reference represent corresponding parts in each of the several views.

IN THE DRAWINGS

DESCRIPTION OF PREFERRED EMBODIMENTS

Figure 1:
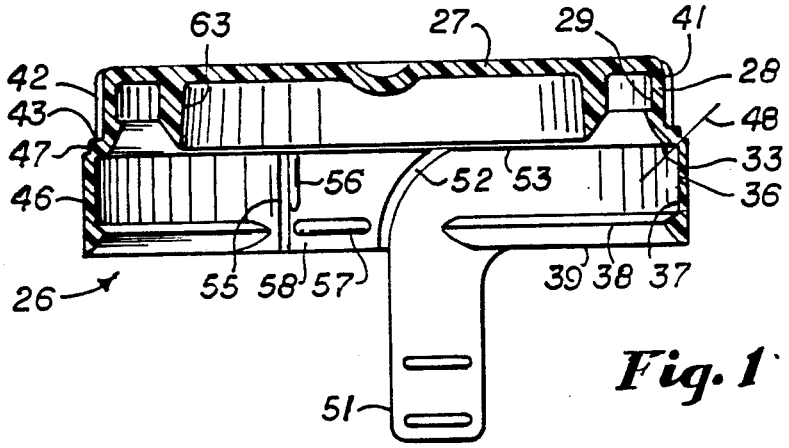
FIG. 1 is a vertical sectional view through a cap in accordance with the present invention.

A typical blow-molded plastic bottle neck 11 is shown having a top edge 12 below which is an external top vertical surface 13. Below surface 13 is an indented vertical surface 14, there being a shoulder or bead 16 at the interface between surfaces 13 and 14. Below surface 14 the exterior of the neck 11 slants downward-outward in a stretch 17 which terminates in a lower bead or shoulder 18. Below the shoulder 18 is a downward-outward slanted surface 19 terminating in a horizontal shoulder 21. Below the shoulder 21 is lower neck 22 which is generally vertical and has bumper ring segments 23 projecting outwardly thereof.

Cap 26 shown in FIGS. 1–4 has a top disk 27, the underside of which seats on the top edge 12 of neck 11. Below disk 27 is upper, outer skirt 28. On the inside of outer skirt 28 is upper vertical internal surface 29 on the lower edge of which is an internal locking bead 31. Below bead 31 there is a downward-outward slanted surface 32 terminating in a horizontal outward directed surface 33.

Below surface 33 is lower skirt 36. The inside of lower skirt 36 has a lower vertical internal surface 37 terminating in a lower internal bead 38 immediately above bottom edge 39.

On the exterior of cap 26, there is an upper external vertical surface 41 immediately below top disk 27, preferably having vertical ribs 42 which assist in grasping the cap. At the lower end of surface 41 is a horizontal outward-directed shoulder 43. The lower skirt 36 has a lower external vertical surface 46. At the intersection of surface 43 and surface 41 is a notch 47 which creates a line of weakness between the inner bottom edge of the notch 47 and the intersection of horizontal surface 33 and surface 37. This line or circle of weakness is referred to hereinafter as the second score line 53.

Extending downward from the lower edge 39 is a tear tab 51 which may be gripped by the user to tear off the lower skirt 36. Extending from one side of tear tab 51 and extending upward from bottom edge 39 in a curved path is first score line 52 which merges with the circle of weakness second score line 53. The score line 53 may be torn for a distance less than 360° up to vertical third score line 55, which extends down to the bottom edge 39. To prevent tearing along the line 53 completely around the circumference of the cap, there is a thickening 56 on the inside of the cap which stops tearing and is alongside third score line 55. Lower bead 38 is interrupted in the region between score lines 52 and 58. The portion of the lower skirt between lines 52 and 55 constitutes a lift tab 58. There may be an internal locking rib 57 on the inside of lift tab 58 which may engage under the shoulder 18. When the lower portion of the skirt is torn away, the portion remaining is a reclosure cap which may be used repeatedly to reclose the container neck as part of the contents of the container are dispensed. The tab 58 is, therefore, used to remove the reclosure cap 51.

An inner skirt 63 is preferably formed depending from top disk 32 and fitting inside the neck 11 in a manner well understood in this art.

Figure 3:
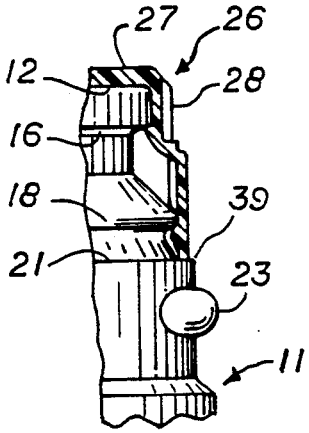
FIG. 3 is a fragmentary sectional view showing the cap of FIG. 2 seated on the neck of FIG. 2.
Figure 2:
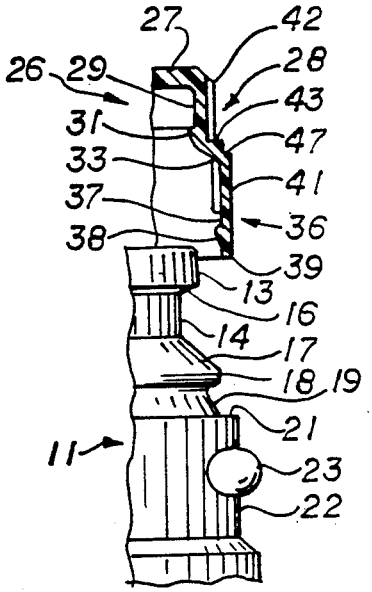
FIG. 2 is a fragmentary exploded view showing a portion of the cap of FIG. 1 and a portion of a bottle neck with which it is used.
Figure 4:
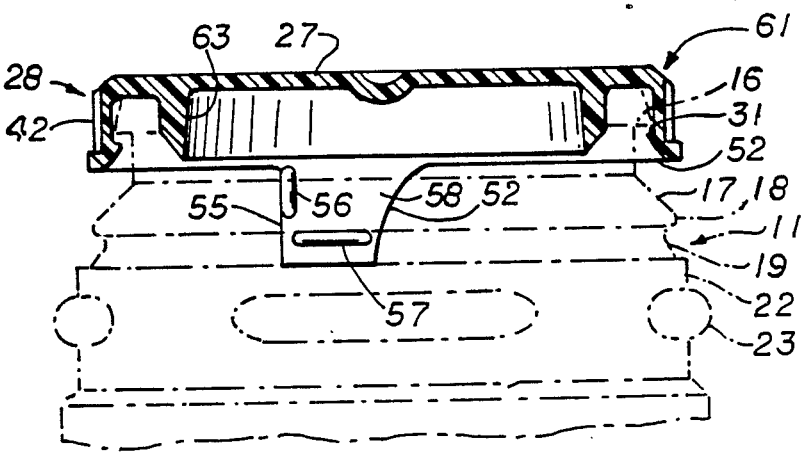
FIG. 4 is a vertical sectional view showing the lower portion of the skirt of the cap torn away and showing in dot-and-dash lines the outline of the neck on which it is seated.
Figure 5:
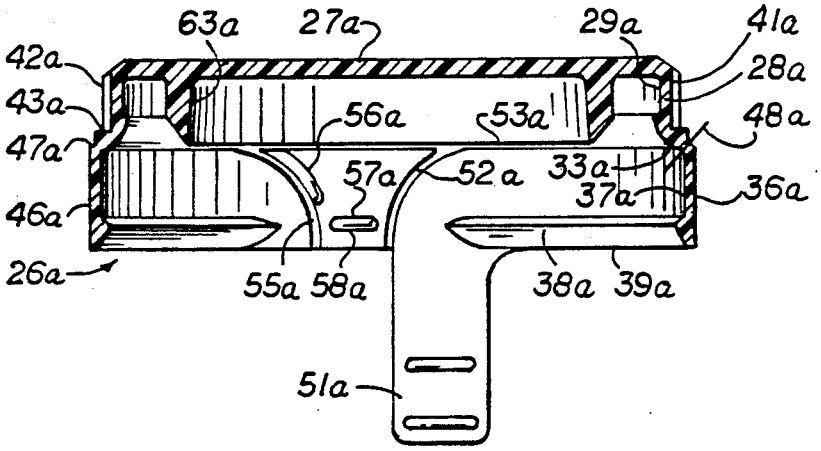
FIGS. 5–8 are views similar to FIGS. 1–4, respectively, of a modification.
Figure 7:
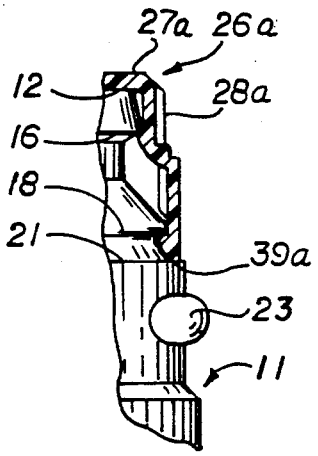
Figure 6:
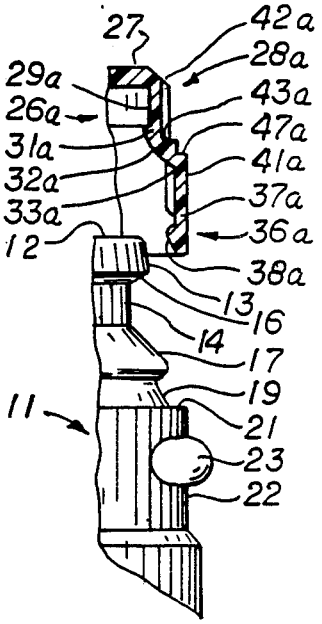
Figure 8:
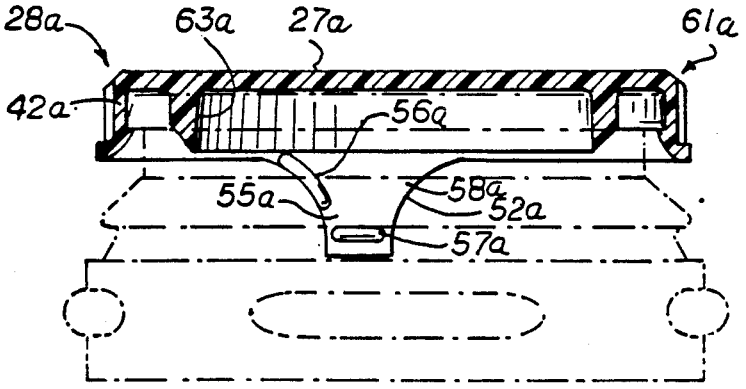

In use, cap 26 is installed on the neck 11 by pushing downward until surface 12 reaches the underside of top disk 27. Surface 29 engages surface 13 and upper locking bead 31 engages under the shoulder 16. Lower bead 38 engages under shoulder 18, all as best shown in FIG. 3.

When it is desired to remove the cap 26, the user grips the tear tab 51 and pulls upwardly, tearing the lower skirt 36 first along first score line 52, thence along circle of weakness second score line 53 until the thickening 56 is reached, whereupon the user pulls downward along score line 55, tearing off the entire lower skirt 36 below the line 53 except for the lift tab 58. To remove the reclosure cap 61 which remains, the user lifts up on the lift tab 58, the lock rib 57 disengaging from the shoulder 18 and further lifting pulls the reclosure cap 61 off the neck 11. The reclosure cap may be reapplied and removed as often as desired until the total contents of the container are dispensed. The modified cap **26*a* shown in FIGS. 5–8 resembles that of the preceding modification, except that the third scoreline 55*a* is curved downwardly, as is the thickening 56*a*. In other respects the cap structure of FIGS. 5–8 resembles that of FIGS. 1–4** and the same reference numerals followed by the subscript a are used to designate corresponding parts.

What is claimed is:

1. A cap for use with a container neck having upper and lower external shoulders comprising a top disk, an outer skirt depending from the periphery of said disk, said skirt having upper bead means positioned to lock under said upper external shoulder and lower bead means positioned to lock under said lower external shoulder, said skirt having a bottom edge and being formed with a first score line extending upward from said bottom edge, a substantially circumferential second score line between said upper and lower bead means, and a third score line extending down from said second score line to said bottom edge, said first and third score lines being spaced from each other with a portion of said skirt therebetween, said portion having a lower edge at substantially the same elevation as said bottom edge of said skirt, a tear tab depending from said bottom edge at a position immediately to the side of said first score line opposite said third score line, said portion comprising a lift tab so that when said skirt has been torn along said first, second and third score lines said lower bead means is removed and said lift tab may be used to pull off of said neck the reclosure remainder of said cap.

2. A cap according to claim 1 which further comprises a lock rib on the inside of said lift tab positioned to engage under said lower external shoulder.

3. A cap according to claim 1 in which said third score line extends substantially perpendicular to said second score line and which further comprises a thickening on the inside of said lift tab extending alongside said third score line perpendicular to said second score line and extending downward from said second score line in the direction of said bottom edge.

4. A cap according to claim 1 having an upper vertical skirt portion having an upper internal vertical surface, said upper internal bead means being located adjacent the bottom of said upper internal vertical surface, a horizontal outward shoulder at the lower end of said upper skirt portion, a lower skirt portion below said horizontal outward shoulder, said lower bead means being on the inner surface of said lower skirt portion, said skirt being formed with a circumferential notch at the intersection of the top of said horizontal outward shoulder and the exterior of said lower skirt portion, said second score line comprising a line of weakness between said notch and the intersection of the underside of said horizontal outward shoulder and the interior of said lower skirt portion.

5. A cap for use with a container neck having upper and lower external shoulders comprising a top disk, an outer skirt depending from the periphery of said disk, said skirt having upper bead means positioned to lock under said upper external shoulder and lower bead means positioned to lock under said lower external shoulder, said skirt having a bottom edge and being formed with a first score line extending upward from said bottom edge, and a second score line extending upward from said bottom edge, said first and second score lines being spaced from each other with a portion of said skirt therebetween, said portion comprising a lift tab so that when said skirt has been torn along said first and second score lines said lift tab may be used to pull off of said neck the reclosure remainder of said cap, said portion having a lower edge at substantially the same elevation as said bottom edge of said skirt, said lower bead means being discontinuous between said first and second score lines, and a lock rib on the inside of said lift tab positioned to engage under said lower external shoulder.

6. A cap according to claim 5 in which said first and second score lines extend substantially perpendicular to said bottom edge.

7. A cap according to claim 5 having an upper vertical skirt portion having an upper internal vertical surface, said upper internal bead means being located adjacent the bottom of said upper internal vertical surface, a horizontal outward shoulder at the lower end of said upper skirt portion, a lower skirt portion below said horizontal outward shoulder, said lower bead means being on the inner surface of said lower skirt portion, said skirt being formed with a circumferential notch at the intersection of the top of said horizontal outward shoulder and the exterior of said lower skirt portion, said second score line comprising a line of weakness between said notch and the intersection of the underside of said horizontal outward shoulder and the interior of said lower skirt portion.

* * * * *